US009315429B2

(12) United States Patent
Fedorov et al.

(10) Patent No.: US 9,315,429 B2
(45) Date of Patent: Apr. 19, 2016

(54) AMMONIUM NITRATE FUEL OIL MIXTURES

(75) Inventors: Andrei B. Fedorov, Derby (GB); Barry Love, Beverly (GB)

(73) Assignee: The Lubrizol Corporation, Wickliffe, OH (US)

( * ) Notice: Subject to any disclaimer, the term of this patent is extended or adjusted under 35 U.S.C. 154(b) by 563 days.

(21) Appl. No.: 13/813,529

(22) PCT Filed: Jul. 27, 2011

(86) PCT No.: PCT/US2011/045503

§ 371 (c)(1), (2), (4) Date: Jan. 31, 2013

(87) PCT Pub. No.: WO2012/018655

PCT Pub. Date: Feb. 9, 2012

(65) Prior Publication Data

US 2013/0140871 A1 Jun. 6, 2013

Related U.S. Application Data

(60) Provisional application No. 61/370,225, filed on Aug. 3, 2010.

(51) Int. Cl.

| | |
|---|---|
| ***C06B 31/30*** | (2006.01) |
| ***C06B 23/00*** | (2006.01) |
| ***C06B 31/28*** | (2006.01) |
| ***C06B 47/00*** | (2006.01) |
| ***E21C 37/00*** | (2006.01) |

(52) U.S. Cl.

CPC ..... *C06B 31/30* (2013.01); *C06B 23/001* (2013.01); *C06B 31/285* (2013.01); *C06B 47/00* (2013.01); *E21C 37/00* (2013.01)

(58) Field of Classification Search

None

See application file for complete search history.

(56) References Cited

U.S. PATENT DOCUMENTS

| | | | | |
|---|---|---|---|---|
| 2,975,046 | A | | 3/1961 | Cooley et al. |
| 3,111,437 | A | | 11/1963 | Kino et al. |
| 3,180,844 | A | | 4/1965 | Dickerson |
| 3,919,016 | A | | 11/1975 | Dubrow |
| 4,141,766 | A | * | 2/1979 | Cameron et al. ..... 149/2 |
| 5,244,475 | A | | 9/1993 | Lownds et al. |
| 5,454,890 | A | * | 10/1995 | Evans et al. ..... 149/46 |

FOREIGN PATENT DOCUMENTS

| | | | |
|---|---|---|---|
| EP | 0276934 | A2 | 8/1988 |
| EP | 0987695 | A1 | 8/1999 |
| GB | 1523958 | A | 9/1978 |
| JP | 2005255504 | A | 9/2005 |
| WO | 97/34475 | A1 | 9/1997 |
| ZA | 9203339 | A | 12/1992 |

* cited by examiner

*Primary Examiner* — Sunil Singh

(74) *Attorney, Agent, or Firm* — Christopher P. Demas; Christopher D. Hilker; Teresan W. Gilbert

(57) ABSTRACT

The present invention relates to ammonium nitrate fuel oil mixtures, and includes compositions comprising (a) ammonium nitrate, (b) a fuel component, (c) a functionalized polymer component, and (d) an oil-soluble anionic surfactant, wherein the mixture of components (b), (c) and (d) form a gel that will not readily flow. The compositions of the present invention provide improve fuel retention and/or water resistance properties, particularly when the compositions use low quality porous prills of ammonium nitrate.

13 Claims, No Drawings

AMMONIUM NITRATE FUEL OIL MIXTURES

CROSS REFERENCE TO RELATED APPLICATION

This application claims priority from PCT Application Ser. No. PCT/US2011/044503 filed on Jul. 27, 2011, which claims the benefit of U.S. Provisional Application No. 61/370,225 filed on Aug. 3, 2010.

BACKGROUND OF THE INVENTION

The present invention relates to ammonium nitrate fuel oil mixtures.

Ammonium nitrate-containing explosives are manufactured and used widely in large volumes. Ammonium nitrate is a relatively strong oxidizing agent. However, it is not readily detonated by itself, and it is therefore generally admixed with various fuels, modifiers and sensitizers which themselves are either explosive or non-explosive. These ammonium nitrate-containing explosives may be divided into four general types: dry blasting agents; slurry or gel explosives; emulsion (and emulsion blend) explosives; and nitroglycerin-based explosives.

For many years, ammonium nitrate fuel oil ("ANFO") has been one of the most popular explosives for use in mining operations. ANFO compositions are formed of porous ammonium nitrate prills and diesel oil that is situated within many of the voids of the porous ammonium nitrate prills. In mining operations, the use of ANFO typically involves drilling a blast hole in the earth that is being mined. After a blast hole has been drilled, one or more initiators and ANFO are loaded into the blast hole. The ANFO is then detonated with the result being that the earth that is being mined is fractured in a manner that facilitates the removal of the earth by machinery for further processing. Typically, an array of blast holes is established and the ANFO established in the blast holes is detonated simultaneously or in a sequence that is designed to produce desired blast characteristics.

In their simplest form ANFO explosives consist of two readily available commercial components: ammonium nitrate (AN) and an organic liquid fuel such as fuel oil or diesel. As mentioned above, the AN is typically used in the form of prills (spherical or roughly spherical particles up to a few mm in diameter, for example from 0.9 to 3.0 mm) and these may be manufactured in such a way, and/or with included minor added components, to improve their porosity giving porous prilled AN (PPAN). The AN and liquid fuel are mixed at specific ratios in order to control the oxygen balance and generate the most efficient explosion possible. Typically the weight ratio used is at or around 94:6 AN:liquid fuel. Regardless of what ratio is desired, it is therefore preferable for the AN, or typically PPAN, to have sufficient porosity to absorb, and retain, the desired amount of fuel. When the ratio of 94:6 is used, it would be desirable for the AN to absorb at least 6% by weight of liquid fuel and then retain this liquid fuel during storage and use.

Good quality PPAN will generally be characterized by the presence of small pores in the prill interior which will confer high oil absorption and good liquid fuel retention (the fuel is absorbed and stays absorbed over time). Low quality PPAN may contain large voids or holes which confer good oil absorption but poor liquid fuel retention (the fuel is absorbed but leaks out over time). Dense AN prills may also be encountered which may have little or no porous nature, or a single large hole or void connected to the exterior; the remainder of the particle being highly crystalline and relatively free of voids. Such dense prills may be expected to show poor absorption and/or retention of the liquid fuel when used to prepare ANFO.

Poor retention of the liquid fuel in the ANFO can cause problems for users and in extreme cases some of the liquid fuel may separate and e.g. may collect in the bottom of bags or other containers of ANFO. If such separation occurs either before or after an ANFO product is loaded into a borehole a poor blast may result from an incorrect ratio of AN and liquid fuel (incorrect oxygen balance).

Thus there is a need to improve the fuel retention properties of ANFO compositions, particularly with regards to low quality PPAN.

Furthermore, a major disadvantage of ANFO as a blasting product is that AN is very soluble in water. ANFO has little or no resistance to water and therefore cannot always be used in wet conditions. Different systems have been proposed to improve on the water resistance of ANFO by the addition of various additives such as gelling agents, hydrophobic thickeners and hydrophobic compounds. These additives can work to repel water and/or form a barrier between water and the bulk of the ANFO product. The use of these additives adds cost to the compositions and low quality PPAN is even more susceptible to water.

Thus there is a continued need to improve the water resistance properties of ANFO compositions, particularly with regards to low quality PPAN.

SUMMARY OF THE INVENTION

The present invention provides a composition comprising (a) ammonium nitrate, (b) a fuel component, (c) a functionalized polymer component, and (d) an oil-soluble anionic surfactant, wherein the mixture of components (b), (c) and (d) form a gel that will not readily flow.

The invention provides for compositions: wherein component (a) is in the form of agglomerates and/or prills; wherein component (b) comprises diesel oil, mineral oil, vegetable oil, mono- and/or di-esters of vegetable oil, reclaimed oil, or combinations thereof; wherein component (c) comprises the reaction product of an olefin copolymer and an unsaturated carboxylic acylating agent, or any combination thereof.

The invention provides for any of the compositions described above wherein the compositions further comprise component (d), an overbased calcium sulfonate detergent, an overbased sodium sulfonate detergent, or combinations thereof.

The invention further provides a method for using an explosive in a mining operation comprising: providing an explosive composition comprising the composition of claim 1; and loading said explosive composition into a blast hole that has been established in the earth.

The invention further provides a method of preparing an explosive composition, the method comprising the step of mixing: (a) ammonium nitrate; (b) a liquid fuel component; (c) a functionalized polymer component; (d) an oil-soluble anionic surfactant; wherein the mixture of components (b), (c) and (d) form a gel that will not readily flow.

The invention further provides the compositions and methods described herein where the explosive composition further includes a solid fuel component. This solid fuel component may be in addition to or in place of some portion of the liquid fuel component. In such embodiments the composition of the invention comprises (a) ammonium nitrate, (b) a fuel component which comprises a liquid fuel component and a solid fuel, (c) a functionalized polymer component, and (d) an oil-soluble anionic surfactant, wherein the mixture of components (b), (c) and (d) form a gel that will not readily flow. In some embodiments the solid fuel component may actually replace the liquid fuel component described above. In such embodiments the composition of the invention comprises (a) ammonium nitrate, (b) a solid fuel component, (c) a functionalized polymer component, and (d) an oil-soluble anionic surfactant, wherein the mixture of components (b), (c) and (d) form a gel that will not readily flow.

DETAILED DESCRIPTION OF THE INVENTION

Various features and embodiments of the invention will be described below by way of non-limiting illustration.

The compositions of the present invention include: (a) ammonium nitrate; (b) a fuel component; (c) a functionalized polymer component; (d) an oil-soluble anionic surfactant; wherein the mixture of components (b), (c) and (d) form a gel that will not readily flow.

To determine if the compositions form a gel that will not readily flow, a composition is formed by thoroughly mixing the components (b), (c), and (d) together. The composition is then observed to see if a gel has formed and the composition is no longer in a multi-phase and/or liquid state that can flow and/or move when the container the composition is held within is tilted.

To determine the relative stability of the compositions of the present invention, a composition is prepared as described herein. The composition is then stored at ambient conditions and observed. Observations may be taken at 2 hours, 24 hours and 7 days or even longer periods to check for separation of the components. The less separation observed, particularly in comparison to comparable non-inventive examples, the better the stability of the composition.

To determine the relative water resistance of the compositions of the present invention, a composition is prepared as described herein. Some amount of the composition (for example 40 grams of the composition obtained by blending components (a), (b), (c), and (d), present in a sample beaker) is then exposed to water (for example the surface of the composition can be moistened). The sample can be allowed to stand for some amount of time (for example, 1 minute). Then an additional amount of water (for example, 10 grams) may be added. The composition may then be stored at ambient conditions and observed to evaluate its water resistance. During the observation the sample is checked to see how far the water penetrates the surface of the composition, how much if any separation of the components of the composition occurs, and how much if any dissolution of component (a) into the water occurs. All of these factors are indicative of the water resistance of the compositions with the less of each of these conditions seen, particularly in comparison to comparable non-inventive examples, the better the water resistance of the composition.

The Ammonium Nitrate

The compositions of the present invention include an ammonium nitrate (AN) component. In some embodiments the ammonium nitrate is in the form of agglomerate and/or prills.

In some embodiments the AN used in the compositions of the present invention have poor retention properties. By poor retention properties it is meant that the AN is not capable of retaining an adequate amount of the oil and/or liquid fuel component when used to make an ammonium nitrate fuel oil (ANFO) mixture. Generally, an adequate amount is 6% by weight. That is, AN is considered to have adequate retention properties if it can absorb and retain 6% by weight of a fuel component. AN that cannot absorb and retain this amount of fuel component may be considered to have poor retention properties. In other embodiments, AN is considered to have poor retention properties if it cannot absorb and retain at least 6%, 5%, 4% or even 3% by weight of a fuel component. For a composition to adequately absorb and retain a fuel component, it must hold that amount of fuel in a stable form at least long enough for the composition to be used as an explosive. In some embodiments this minimum period of time is 1 week, 2 days, 24 hours or even 12 hours.

The poured bulk density of the AN prills suitable for use in the present invention are not overly limited. In some embodiments the AN component has a poured bulk density greater than about 0.85 g/cc. In some embodiments the AN has this minimum poured bulk density while also having an oil-absorption capacity of less than about 7%.

In some embodiments the ammonium nitrate component of the composition includes porous prilled ammonium nitrate (PPAN) and in some embodiments the PPAN is low quality PPAN. As described above, low quality PPAN is PPAN with poor oil and/or fuel retention properties. These properties may be caused by large voids or holes in the prills, which confer good oil absorption but poor liquid fuel retention. Low quality prills may also be too dense. In these cases the prills have little or no porous nature, or a single large hole or void connected to the exterior; the remainder of the particle being highly crystalline and relatively free of voids. Such dense prills may be expected to show poor absorption and/or retention of the liquid fuel when used to prepare ANFO. In some embodiments of the invention, the compositions described herein are able to use low quality prills without the expected impact in the performance of the explosive composition. In other embodiments, the compositions of the present invention may use good and/or high quality prills and result in more effective compositions than would otherwise be possible, for example having improved water resistance.

The compositions of the invention may be from 90%, 92%, 93% or even 95% by weight up to 98%, 96% or even 95% by weight AN. In some embodiments the compositions are from 92% up to 96% by weight AN or from 93% up to 95% by weight AN.

The Fuel

The compositions of the present invention include a fuel component. The fuel component is not overly limited so long as the fuel component, in some embodiments, is liquid at ambient conditions.

The term "liquid fuel", as used herein, may refer to any liquid petroleum product that is burned in a furnace for the generation of heat or used in an engine for the generation of power. In addition, the term fuel may include: (a) suitable substitutes for such liquid petroleum products, such as mineral oils, and (b) combinations of such liquid petroleum products and suitable substitutes.

In some embodiments the fuel component includes one or more organic fuels. Suitable organic fuels include aliphatic, alicyclic, and/or aromatic fuels and can be saturated and/or unsaturated, so long as they are liquid at the formulation temperature. In some embodiments the fuel may include tall oil, mineral oil, paraffin oils, toluene, xylenes, mixtures of liquid hydrocarbons generally referred to as petroleum distillates including diesel fuels, and vegetable oils such as corn oil, cotton seed oil, peanut oil, and soybean oil. In some embodiments the fuel includes mineral oil, No. 2 fuel oil, and mixtures thereof. Aliphatic and aromatic nitro compounds and chlorinated hydrocarbons also can be used. Mixtures of any of the above can be used.

In some embodiments the fuel component includes diesel oil, mineral oil, vegetable oil, mono- and/or di-esters of vegetable oil, reclaimed oil, or combinations thereof. The term reclaimed oil includes all used and/or recycled oils that have been used in one or more applications and have then been collected for use in these compositions as opposed to be disposed of.

One or more of the other components of the compositions described here may contain a diluent, such as mineral oil. In some embodiments this diluent is treated as part of the component with regards to formulation ranges. In other embodiments, the formulation ranges may be applied to one or more of the components on an actives and/or oil free basis. In these embodiments the diluent that is part of the component may be treated as part of the fuel component of the overall composition.

The compositions of the present invention may be from 1%, 2%, 3% or even 4% by weight up to 10%, 8%, 5.5% or even 4.5% by weight fuel. In some embodiments the compositions are from 4% up to 8% by weight fuel or even at least 5%, 6%, or 7% by weight fuel. These ranges may apply when all of the components are treated on an oil-free basis, and so all of the diluent oil included in the composition is treated as part of the fuel component, or when each component is treated as including any diluent that was added along with it.

The ranges above may be applied to the fuel component when it is made up entirely of liquid fuel, when it is made up entirely of solid fuel, or when it is made up of a mixture of liquid and solid fuel. When the fuel component contains a mixture of solid fuel and liquid fuel, the ratio of the liquid fuel to the solid fuel is not overly limited. In some embodiments the liquid fuel to solid fuel weight ratio is from 10:1 to 1:10, or from 10:1 to 1:5 or 1:1, or from 5:1 or 1:1 to 1:10 or 1:5. In still other embodiments the weight ratio of the liquid fuel to solid fuel is from 5:1 to 1:1.

The term "solid fuel" as used herein, may refer to any range of high energy materials which are slow burning and will act to increase the time during which pressure builds up during an explosive event to thereby aid in reducing the shock wave component of the blast and improving the heave component. In some embodiments the solid fuel is a rubber, a plastic such as polystyrene, polyethylene and polybutylene, gilsonite, solid form unexpanded polystyrene, acrylonitrile-butadiene-styrene, waxed wood metal, rosin and the like, or any combination thereof. Suitable examples of rubber include both natural and synthetic rubbers. In some embodiments the solid fuel is a natural rubber, a synthetic rubber, a polystyrene plastic, a polyethylene plastic, polybutylene plastic, or any combination thereof. In some embodiments the solid fuel is a natural rubber, a synthetic rubber, or some combination thereof. The solid fuel component, when present, is typically in the form of a granular solid, which may or may not be classified.

The Functionalized Polymer

The compositions of the present invention include a functionalized polymer component. In some embodiments the polymer is the reaction product of an olefin polymer and an unsaturated carboxylic acylating agent.

Suitable olefin polymers include homopolymers and copolymers. In some embodiments the olefin polymer is an olefin copolymer. Suitable monomers from which the polymers may be derived are not overly limited.

Suitable olefins include alpha-olefins (sometimes referred to as mono-1-olefins) or isomerized alpha-olefins. Examples of the alpha-olefins include ethylene, propylene, butylene, 1-octene, 1-nonene, 1-decene, 1-dodecene, 1-tridecene, 1-tetradecene, 1-pentadecene, 1-hexadecene, 1-heptadecene, 1-octadecene, 1-nonadecene, 1-eicosene, 1-henicosene, 1-docosene, 1-tetracosene, etc. Commercially available alpha-olefin fractions that may be used include the $C_{15-18}$ alpha-olefins, $C_{12-16}$ alpha-olefins, $C_{14-16}$ alpha -olefins, $C_{14-18}$ alpha-olefins, $C_{16-18}$ alpha-olefins, $C_{16-20}$ alpha-olefins, $C_{22-28}$ alpha-olefins, etc. In one embodiment, the olefins are $C_{16}$ and $C_{16-18}$ alpha -olefins. Additionally, $C_{30}$+ alpha-olefin fractions such as those available from Chevron Phillips Chemical Company LLC can be used. In one embodiment, the olefin monomers include ethylene, propylene and 1-butene. In some embodiments the polymer is a polyisobutylene.

Suitable monomers may also include ethylene, propylene, butylene and combinations thereof. In some embodiments the polymer is a copolymer of two or more of these monomers. In some embodiments the polymer is a copolymer that includes ethylene and propylene derived units. In an embodiment where the polymer is a copolymer of two monomers, such as an ethylene-propylene copolymer, the ratio of the different monomer units is not overly limited. In some embodiments, where the copolymer contains ethylene and propylene units, the ratio between ethylene and propylene unit may be from 40:60 to 55:45. In other embodiments where the polymer is ethylene-propylene copolymer, the copolymer may contain from 40 to 55% by weight ethylene units and/or 45 to 60% by weight ethylene units.

In some embodiments suitable polymers include styrene-butadiene copolymer or may include such a polymer with an olefin polymer, which may be partially hydrogenated. In some embodiments the styrene-butadiene copolymer are only useful when functionalized in an oil process, as opposed to reactive extrusion. In other embodiments the polymer of the present invention is free of any substantial amount of styrene-butadiene copolymer. By substantial amount it is meant less than an amount that would materially impact the composition but which may also mean less than 20, 10 5, 1 or even 0.5 percent by weight of the polymer component. In some embodiments the polymer component is free of any styrene-butadiene copolymer.

Suitable unsaturated carboxylic acylating agents are not overly limited. In some embodiments the agents include carboxylic acid and/or anhydride. In some embodiments the agent has at least two carboxy functionalities in the form of acids or anhydride(s). In some embodiments the additive is a succinic, itaconic, citraconic, or maleic acylating agent. In one embodiment the agent is a maleic acid and/or anhydride. Once prepared, the functionalized copolymer may be from 1% to 10%, or from 2% to 5%, or even about 2% to 3% by weight incorporated acylating agent.

The functionalized copolymers suitable for use in the invention may have a number average molecule weight (Mn) from 50,000 to 200,000. In some embodiments the polymer has a Mn from 20,000, 50,000 or even 80,000 up to 200,000, 180,000, 150,000 or even 100,000. In some embodiments the Mn of the functionalized polymer may range from 50,000 to 180,000 or from 90,000 to 100,000 or be even about 95,000.

In some embodiments the functionalized copolymer includes a maleic anhydride functionalized olefin copolymer having a number average molecular weight from 50,000 to 200,000. In some of these embodiments the olefin copolymer is an ethylene-propylene copolymer and the Mn of the polymer is from 85,000 to 120,000 or from 90,000 to 110,000 prior to functionalization.

The compositions of the invention may contain from 0.1% to 2.5% by weight of the functionalized polymer component. In various embodiments the compositions contain from 0.1%, 0.5%, or 1.0% up to 2.5%, 1.5% or even 1.0% by weight functionalized polymer component. The functionalized polymer component may itself contain one or more functionalized polymers and one or more diluents such as a solvent or mineral oil. The functionalized polymer component may be anywhere from 5% to 100% by weight functionalized polymers and 0% to 95% by weight diluent. In some embodiments the functionalized polymer is from 4%, 5% or 10% to 50%, 40%, 20% or even 15% functionalized polymer. In some embodiments the functionalized polymer is about 10% by weight functionalized polymer with the balance made up with diluent, such as mineral oil.

In some embodiments the polymers of the present invention are functionalized by reacting the polymer with the acylating agent in oil, via a batch reaction. In other embodiments the polymers of the present invention are functionalized by reacting the polymer with the acylating agent via reactive extrusion.

The Oil-Soluble Anionic Surfactant

The compositions of the present invention include an oil-soluble anionic surfactant. In some embodiments the surfactant includes a source of mono and/or di- and/or trivalent metal ions that are delivered to the composition.

In some embodiments the surfactant delivers calcium ions, magnesium ions, sodium ions, zinc ions or combinations thereof to the composition. In some embodiments the surfactant is substantially free to free of molybdenum ions and/or the ability to deliver molybdenum ions to the composition.

In one embodiment the surfactant is in the form of a neutral or overbased surfactant, typically salted with an alkali or alkaline earth metal. Suitable metals include lithium, potassium, sodium, calcium or magnesium. In some embodiments the metal is sodium and/or calcium.

In one embodiment the surfactant is a derivative of a polyolefin. Typical examples of suitable polyolefins include polyisobutene; polypropylene; polyethylene; a copolymer derived from isobutene and butadiene; a copolymer derived from isobutene and isoprene; or mixtures thereof.

Typically the derivative of a polyolefin comprises a polyolefin-substituted acylating agent optionally further reacted to form an ester, aminoester, imide, and/or amide. The acylating agents and polyolefins suitable for use in the invention as additional surfactants are similar to those described above, and may also include polyisobutylene succinic anhydrides and derivatives thereof. Typical derivatives of polyisobutylene succinic anhydrides include hydrolysed succinic anhydrides, esters or diacids. Polyisobutylene succan derivatives are preferred to make the metal base dispersions. A large group of polyisobutylene succinic anhydride derivatives are taught in U.S. Pat. Nos. 4,708,753, and 4,234,435.

In another embodiment the surfactant comprises a salixarene (or salixarate if in the form of a metal salt). The salixarene is defined as an organic substrate of a salixarate. A detailed description of salixarene and salixarate chemistry is disclosed in EP 1 419 226 B1, including methods of preparation as defined in Examples 1 to 23 (page 11, line 42 to page 13, line 47).

In one embodiment the surfactant is substantially free of, to free of, a fatty acid or derivatives thereof, such as esters. In one embodiment the surfactant is other than a fatty acid or derivatives thereof.

In one embodiment the surfactant comprises at least one of hydrocarbyl substituted aryl sulphonic acids, derivatives of polyolefins, polyesters or salixarenes (or salixarates).

In different embodiments the surfactant is substantially free of, to free of, phospholipids, (such as lecithin) and/or amino acids (such as sarcosines).

In one embodiment the optional additional surfactant comprises a hydrocarbyl substituted aryl sulphonic acid, a polyolefin-substituted acylating agent, a salixarene, or a mixture or two or more thereof. In one embodiment the polyolefin-substituted acylating agent is a polyisobutylene succinic anhydride or derivatives thereof.

In other embodiments the surfactant includes an overbased detergent. Overbased detergents generally obtain most or all of their basicity or TBN from the presence of basic metal-containing compounds (metal hydroxides, oxides, or carbonates, typically based on such metals as calcium, magnesium, or sodium). Such metallic overbased detergents, also referred to as overbased or superbased salts, are generally single phase, homogeneous Newtonian systems characterized by a metal content in excess of that which would be present for neutralization according to the stoichiometry of the metal and the particular acidic organic compound reacted with the metal. The overbased materials are typically prepared by reacting an acidic material (typically an inorganic acid or lower carboxylic acid such as carbon dioxide) with a mixture of an acidic organic compound (also referred to as a substrate), a stoichiometric excess of a metal base, typically in a reaction medium of an one inert, organic solvent (e.g., mineral oil, naphtha, toluene, xylene) for the acidic organic substrate. Typically also a small amount of promoter such as a phenol or alcohol is present, and in some cases a small amount of water. The acidic organic substrate will normally have a sufficient number of carbon atoms to provide a degree of solubility in oil.

Such conventional overbased materials and their methods of preparation are well known to those skilled in the art. Patents describing techniques for making basic metallic salts of sulfonic acids, carboxylic acids, phenols, phosphonic acids, and mixtures of any two or more of these include U.S. Pat. Nos. 2,501,731; 2,616,905; 2,616,911; 2,616,925; 2,777,874; 3,256,186; 3,384,585; 3,365,396; 3,320,162; 3,318,809; 3,488,284; and 3,629,109. Salixarate detergents are described in U.S. Pat. No. 6,200,936.

In some embodiments the surfactant is an overbased calcium sulfonate detergent, an overbased sodium sulfonate detergent, or combinations thereof.

The compositions of the invention may contain from 0.1% to 1.5% by weight of the surfactant component. In various embodiments the compositions contain from 0.1%, 0.25%, or 0.5% up to 1.5%, 1.0% or even 0.75% by weight surfactant component. In some embodiments the compositions are about 0.5% by weight surfactant component. The surfactant component may itself contain one or more surfactants and one or more diluents such as a solvent or mineral oil. The surfactant component may be anywhere from 5% to 100% by weight surfactant and 0% to 95% by weight diluent. In some embodiments the surfactant is from 20%, 30%, 40% or even 55% up to 80%, 70% or even 60% surfactant. In some embodiments the surfactant is about 50% to 60% by weight surfactant with the balance made up with diluent, such as mineral oil.

The compositions of the present invention may contain one or more additional additives and/or components suitable for use in ANFO compositions. Such additives and components are known to those skilled in the art and are not overly limited. In one embodiment the compositions of the present invention include an antioxidant, for example, butylated hydroxytoluene.

The additional additives, when present, are generally present at less than 2%, 1% or even 0.1% by weight of the composition. These additives, just as the functionalized polymer and surfactant may contain some amount of diluent. The ranges of active component contents described above may also be applied to any additional additives present in the composition.

INDUSTRIAL APPLICATION

The compositions of the present invention are prepared by mixing the components described above. The means of mixing are not overly limited so long as the means does not destroy the structure of the AN prills but provides sufficient mixing to allow the fuel component to be fully absorbed. In some embodiments the functionalized polymer component and surfactant component are mixed into the fuel component before the addition of the AN component. In other embodiments each component is added to the AN separately.

In some embodiments the AN is first combined with the functionalized polymer component. As noted above the functionalized polymer component may contain some amount of diluent, in other embodiments the component is neat. In some embodiments the functionalized polymer component is mixed with a portion or even all of the fuel components and is then added to the AN. The surfactant component is then added. As noted above the surfactant component may contain some amount of diluent, in other embodiments the component is neat. In some embodiments the surfactant component is mixed with a portion or even all the fuel component and is then added to the AN-containing mixture. The resulting mixture is a combination of the AN, the fuel component, the functionalized polymer component and the surfactant component.

While not wishing to be bound by theory it is believed that the combination of the functionalized polymer component and surfactant component are required to provide improved fuel retention and/or water resistant properties. The use of these components, particularly in combination with one another, in ANFO compositions and/or the surprising improvement in ANFO properties they provide are believed to represent an unexpected result over the prior art.

The compositions of the invention may include the functionalized polymer component and surfactant component such that the weight ratio of functionalized polymer component to surfactant component is from 1:1 to 3:1 or even about 2:1, wherein the functionalized polymer component contains one or more functionalized polymers at 5% to 15% by weight in a diluent, and wherein the surfactant component contains one or more surfactants at 35% to 45% by weight in a diluent. Suitable diluents include mineral oil and other similar materials. Presented another way, the weight ratio of functionalized polymer to surfactant in the compositions of the invention, on an actives and/or oil-free basis, may be from 1:2 to 1:4 or even about 1:3.

The explosive composition is used in mining operations by loading the composition one or more blast holes together with an appropriate detonating device. Typically, the detonating device is loaded into a blast hole prior to the loading of the explosive composition into the blast hole. A blast engineer determines the amount of explosive that is to be loaded into each hole and a weighing system on the vehicle that transports the composition to the blast hole or holes is used to load the appropriate amount of the explosive composition in each hole. As previously, the explosive composition can be manufactured on the blast site. Further, the explosive composition can be manufactured on site and on a mobile vehicle that can then be used to transport the composition to the blast hole or holes.

The invention provides a method of using an explosive in a mining operation comprising: providing one or more of the explosive compositions described above and loading said explosive composition into a blast hole that has been established in the earth.

It is known that some of the materials described above may interact in the final formulation, so that the components of the final formulation may be different from those that are initially added. For instance, metal ions (of, e.g., a detergent) can migrate to other acidic or anionic sites of other molecules. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

EXAMPLES

The invention will be further illustrated by the following examples, which sets forth particularly advantageous embodiments. While the examples are provided to illustrate the present invention, they are not intended to limit it.

Comparative Example 1

An ammonium nitrate fuel oil (ANFO) composition is prepared by mixing 94 grams of Ammonium Nitrate (AN) prills with poor fuel retention properties (having a poured bulk density of about 0.96 grams/cm$^3$) and 6 grams of diesel fuel (ultra low sulfur diesel fuel, ULSD) The resulting composition contains 6 grams of fuel and 0 grams of diluent oil. The composition is placed in a glass cylinder and observed over time at ambient conditions to evaluate its fuel retention properties.

After 2 hours the fuel is visibly separating from the AN with fuel visible around the AN prills. After 24 hours more separation is visible. After 1 week the separation is even more pronounced. This result is indicative of poor fuel retention properties and will be used as a baseline for the other examples.

Comparative Example 2

A composition is prepared according to Example 1 except that the composition is prepared from 94 grams of the AN prills and 6 grams of a mixture where the mixture is 83.3% by weight diesel fuel and 16.7% of a functionalized polymer, which is itself about 90% by weight diluent oil. The resulting composition contains about 5 grams of fuel and about 0.9 grams of oil. The composition is placed in a glass cylinder and observed over time at ambient conditions to evaluate its fuel retention properties.

After 2 hours no separation of fuel from the AN prills is visible. After 24 hours some separation of the fuel from the AN prills is visible but to a much smaller extent than seen in Comparative Example 1 at 24 hours. After 1 week the separation is more pronounced but is still less than that seen in Comparative Example 1. This result is better than that seen in Comparative Example 1 but is still indicative of poor fuel retention properties.

Inventive Example 3

A composition is prepared according to Comparative Example 1 except that the composition is prepared from 94 grams of the AN prills and 4 grams of a first mixture where the first mixture is 75% by weight diesel fuel and 25% of a functionalized polymer, which is itself about 90% by weight diluent oil. The resulting composition is then mixed with 2 grams of a second mixture where the second mixture is 75% by weight diesel fuel and 25% of a calcium sulfonate surfactant, which is itself about 40% by weight diluent oil. The resulting composition contains about 4.5 grams of fuel and about 1.1 grams of oil. The composition is placed in a glass cylinder and observed over time at ambient conditions to evaluate its fuel retention properties.

After 2 hours no separation of fuel from the AN prills is visible. After 24 hours no separation of fuel from the AN prills is visible. After 1 week no separation of fuel from the AN prills is visible. After 21 days no separation of fuel from the AN prills is visible. This result is indicative of good fuel retention properties and is significantly better than the results seen in either Comparative Example 1 or Comparative Example 2.

Comparative Example 4

A composition is prepared according to the procedure of Comparative Example 1 above and is then tested to evaluate is water resistance properties. A 40 gram sample of the composition is placed in a 50 ml plastic beaker at ambient conditions. The surface of the composition is then moistened by applying a small amount of water (less than 2 grams). The composition is held for 1 minute. Then 10 grams of water is added to the beaker, on top of the composition. The composition is then held at ambient conditions to evaluate its water resistance properties.

After 15 minutes the water has penetrated the surface of the AN prills and there is a small amount of fuel visible on the surface of the water. After 24 hours there is a visible layer fuel on top of the water and the AN prills have been partially dissolved by the water. This result is indicative of poor water resistance properties and will be used a baseline for the other example.

Inventive Example 5

A composition is prepared according to the procedure of Comparative Example 3 above and is then tested to evaluate is water resistance properties. The same testing procedure described in Comparative Example 4 is used in this example to evaluate its water resistance properties.

After 15 minutes the water has penetrated the surface of the AN prills but there is no fuel visible on the surface of the water. After 24 hours there is only a trace of fuel visible on the surface of the water and while the AN prills have been partially dissolved by the water, it is to a much smaller extent than that seen in Example 4. This result is indicative of good water resistance properties and is significantly better than the results seen in Comparative Example 4.

Gelation Example Sets

Several sets of examples are prepared to evaluate the gelling properties of various compositions. In some embodiments it is desirable for the ANFO compositions of the present to form a gel immediately upon mixing, however compositions that form a gel after mixing can also be useful. In some embodiments compositions that do not appear to gel can still be useful if their stability properties are sufficient, however this is generally more likely if the composition gels.

Sets of compositions are prepared utilizing six different functionalized polymers. Within each sample set eight different surfactants are used. All of the examples are prepared using ultra low sulfur diesel fuel. Each functionalized polymer-surfactant combination is then evaluated in a gel screen test. In the screen test a functionalized polymer mixture is combined with a surfactant mixture at a ratio that would also be seen in the ANFO composition. If the composition forms a gel immediately it is considered to have good gelling properties. If the composition forms a gel within 24 hours or even within 8 weeks of mixing, it is an indication of some gelling properties. If the composition does not form a gel within 8 weeks (effectively never forming a gel) it is an indication of poor gelling properties.

For each sample of the gelation example sets, a functionalized polymer mixture is prepared by mixing the functionalized polymer with diesel fuel (ULSD) at a 25:75 weight ratio, wherein each polymer is itself 90% by weight diluent oil. For each sample a surfactant mixture is also mixed up that is a 25:75 weight ratio of surfactant:diesel fuel or oil, wherein each wherein surfactant contains a variable amount of diluent oil and wherein the amount of each surfactant used is adjusted in order to ensure that each surfactant mixture delivers the same amount of metal ions. Then 50 grams of the functionalized polymer mixture is combined with 25 grams of the surfactant mixture (2:1 weight ratio)

Example Set A

Example Set A evaluates an olefin copolymer functionalized with maleic anhydride. The polymer has a number average molecular weight (Mn) of about 95,000 and was functionalized by reactive extrusion. As mentioned above, each sample is prepared by mixing 50 grams of the functionalized polymer mixture with 25 grams of the described surfactant mixture, wherein each functionalized polymer mixture is 75% by weight diesel fuel, each surfactant mixture has an adjusted amount of diesel fuel so that each mixture contains the same amount of metal ions, each functionalized polymer is about 90% by weight diluent oil, and each surfactant has a unique amount of diluent oil. The observations for each example are provided in the table below.

TABLE 1

Gelation of MAA-95,000 Mn OCP Samples

| Ex | Surfactant (% surf in Surf Mix) | At Mixing | At 24 Hrs | At 8 Weeks |
|---|---|---|---|---|
| A-1 | 400 TBN calcium sulfonate (25%)[1] | GELLED | GELLED | GELLED |
| A-2 | 400 TBN magnesium sulfonate (40%) | NO GEL | NO GEL | GELLED |
| A-3 | 400 TBN calcium alkyl-phenate (26%) | NO GEL | GELLED | GELLED |
| A-4 | 500 TBN sodium sulfonate (19%) | GELLED | GELLED | GELLED |
| A-5 | zinc dithiophosphate, ~10% secondary (34%) | NO GEL | NO GEL | GELLED |
| A-6 | zinc dithiophosphate, ~10% primary (35%) | NO GEL | NO GEL | GELLED |
| A-7 | molybdenum dithiocarbamate (38%) | NO GEL | NO GEL | NO GEL |
| A-8 | 165 TBN calcium salicylate (63%) | GELLED | GELLED | GELLED |

[1]The surfactant mixture for Example A-1 contains 25 grams of surfactant, which itself is about 40% by weight diluent oil. The mixture is 25% surfactant and 75% diesel fuel. Each surfactant mixture for each of the other examples in this set has an adjusted amount of surfactant and diesel fuel to ensure that each mixture contains the same amount of metal ions, thus allowing a comparison of the examples.

Example Set B

Example Set B evaluates a non-functionalized olefin copolymer where the polymer has a Mn of about 180,000.

The samples are prepared and tested according to procedures described in Example Set A. The observations for each example are provided in the table below.

TABLE 2

Gelation of 180,000 Mn OCP Samples

| Ex | Surfactant (% surf in Surf Mix) | At Mixing | At 24 Hrs | At 8 Weeks |
|---|---|---|---|---|
| B-1 | 400 TBN calcium sulfonate (25%)[1] | NO GEL | NO GEL | NO GEL |
| B-2 | 400 TBN magnesium sulfonate (40%) | NO GEL | NO GEL | NO GEL |
| B-3 | 400 TBN calcium alkyl-phenate (26%) | NO GEL | NO GEL | NO GEL |
| B-4 | 500 TBN sodium sulfonate (19%) | NO GEL | NO GEL | NO GEL |
| B-5 | zinc dithiophosphate, ~10% secondary (34%) | NO GEL | NO GEL | NO GEL |
| B-6 | zinc dithiophosphate, ~10% primary (35%) | NO GEL | NO GEL | NO GEL |
| B-7 | molybdenum dithiocarbamate (38%) | NO GEL | NO GEL | NO GEL |
| B-8 | 165 TBN calcium salicylate (63%) | NO GEL | NO GEL | NO GEL |

[1]Same note as in Table 1 above applies to Example B-1

Example Set C

Example Set C evaluates an olefin copolymer functionalized with maleic anhydride where the polymer has a Mn of about 19,000 and was functionalized by reactive extrusion. The samples are prepared and tested according to procedures described in Example Set A. The observations for each example are provided in the table below.

TABLE 3

Gelation of MAA-19,000 Mn OCP Samples

| Ex | Surfactant (% surf in Surf Mix) | At Mixing | At 24 Hrs | At 8 Weeks |
|---|---|---|---|---|
| C-1 | 400 TBN calcium sulfonate (25%)[1] | NO GEL | NO GEL | NO GEL |
| C-2 | 400 TBN magnesium sulfonate (40%) | NO GEL | NO GEL | NO GEL |
| C-3 | 400 TBN calcium alkyl-phenate (26%) | NO GEL | NO GEL | NO GEL |
| C-4 | 500 TBN sodium sulfonate (19%) | NO GEL | NO GEL | NO GEL |
| C-5 | 165 TBN calcium salicylate (63%) | NO GEL | NO GEL | NO GEL |

[1]Same note as in Table 1 above applies to Example C-1

Example Set D

Example Set D evaluates a non-functionalized olefin copolymer where the polymer has a Mn of about 15,000. The samples are prepared and tested according to procedures described in Example Set A. The observations for each example are provided in the table below.

TABLE 4

Gelation of 15,000 Mn OCP Samples

| Ex | Surfactant (% surf in Surf Mix) | At Mixing | At 24 Hrs | At 8 Weeks |
|---|---|---|---|---|
| D-1 | 400 TBN calcium sulfonate (25%)[1] | NO GEL | NO GEL | NO GEL |
| D-2 | 400 TBN magnesium sulfonate (40%) | NO GEL | NO GEL | NO GEL |
| D-3 | 400 TBN calcium alkyl-phenate (26%) | NO GEL | NO GEL | NO GEL |

TABLE 4-continued

Gelation of 15,000 Mn OCP Samples

| Ex | Surfactant (% surf in Surf Mix) | At Mixing | At 24 Hrs | At 8 Weeks |
|---|---|---|---|---|
| D-4 | 500 TBN sodium sulfonate (19%) | NO GEL | NO GEL | NO GEL |
| D-5 | 165 TBN calcium salicylate (63%) | NO GEL | NO GEL | NO GEL |

[1]Same note as in Table 1 above applies to Example D-1

Example Set E

Example Set E evaluates a non-functionalized styrene-butadiene copolymer (SBR) where the polymer has a Mn of about 130,000. The samples are prepared and tested according to procedures described in Example Set A. The observations for each example are provided in the table below.

TABLE 5

Gelation of 130,000 Mn SBR Polymer Samples

| Ex | Surfactant (% surf in Surf Mix) | At Mixing | At 24 Hrs | At 8 Weeks |
|---|---|---|---|---|
| E-1 | 400 TBN calcium sulfonate (25%)[1] | NO GEL | NO GEL | NO GEL |
| E-2 | 400 TBN magnesium sulfonate (40%) | NO GEL | NO GEL | NO GEL |
| E-3 | 400 TBN calcium alkyl-phenate (26%) | NO GEL | NO GEL | NO GEL |
| E-4 | 500 TBN sodium sulfonate (19%) | NO GEL | NO GEL | NO GEL |
| E-5 | 165 TBN calcium salicylate (63%) | NO GEL | NO GEL | NO GEL |

[1]Same note as in Table 1 above applies to Example E-1

Example Set F

Example Set F consists of 1 sample (F-1) that is identical to Example A-1 above (same functionalized polymer, surfactant and formulation) except that the diesel fuel in the functionalized polymer mixture and the surfactant mixture is replaced with 100N mineral oil. The resulting sample gelled immediately upon mixing.

Example Set G

Example Set G evaluates four different functionalized polymers where each of the polymers is functionalized with maleic anhydride in oil and designed to have 2.4% MAA grafting. The samples are prepared and tested according to procedures described in Example Set A. Each example in Example Set G uses a 400 TBN calcium sulfonate, present at 25 percent by weight of the surfactant mixture. The observations for each example are provided in the table below.

TABLE 6

Gelation of Various Polymer Samples

| Ex | Polymer (% poly in Polymer Mixture) | At Mixing | At 24 Hrs | At 4 Weeks |
|---|---|---|---|---|
| G-1 | MAA-180,000 Mn OCP (25%) | NO GEL | GELLED | GELLED |
| G-2 | MAA-15,000 Mn OCP (25%) | NO GEL | NO GEL | NO GEL |
| G-3 | MAA-50,000 Mn OCP (25%) | NO GEL | GELLED | GELLED |
| G-4 | MAA-130,000 Mn SBR (25%) | TRACE | TRACE | TRACE |

[1]The polymer mixture for Example G-1 contains 50 grams of polymer, which itself contains some diluent oil. The mixture is 25% polymer and 75% diesel fuel. Each polymer mixture for in this set has the same amount of polymer present in the polymer mixture.

Example Set H

Example Set H evaluates the polymer of G-1 above, an olefin copolymer functionalized with maleic anhydride where the polymer has a Mn of about 180,000 and was functionalized in oil. The samples are prepared and tested according to procedures described in Example Set A. The observations for each example are provided in the table below.

TABLE 7

Gelation of MAA-180,000 Mn OCP Samples

| Ex | Surfactant (% surf in Surf Mix) | At Mixing | At 24 Hrs | At 4 Weeks |
|---|---|---|---|---|
| H-1 | 400 TBN calcium sulfonate (25%)[1,2] | NO GEL | GELLED | GELLED |
| H-2 | 400 TBN magnesium sulfonate (40%) | NO GEL | NO GEL | NO GEL |
| H-3 | 400 TBN calcium alkyl-phenate (26%) | NO GEL | NO GEL | NO GEL |
| H-4 | 500 TBN sodium sulfonate (19%) | NO GEL | NO GEL | NO GEL |
| H-5 | zinc dithiophosphate, ~10% secondary (34%) | NO GEL | NO GEL | NO GEL |
| H-6 | zinc dithiophosphate, ~10% primary (35%) | NO GEL | NO GEL | NO GEL |
| H-7 | molybdenum dithiocarbamate (38%) | NO GEL | NO GEL | NO GEL |
| H-8 | 165 TBN calcium salicylate (63%) | NO GEL | NO GEL | NO GEL |

[1]Same note as in Table 1 above applies to Example H-1

[2]Example H-1 is the same sample as Example G-1 above, and included here for completeness.

Example Set I

Example Set I evaluates the polymer of G-3 above, an olefin copolymer functionalized with maleic anhydride where the polymer has a Mn of about 15,000 and was functionalized in oil. The samples are prepared and tested according to procedures described in Example Set A. The observations for each example are provided in the table below.

TABLE 8

Gelation of MAA-50,000 Mn OCP Samples

| Ex | Surfactant (% surf in Surf Mix) | At Mixing | At 24 Hrs | At 4 Weeks |
|---|---|---|---|---|
| I-1 | 400 TBN calcium sulfonate (25%)[1,2] | NO GEL | GELLED | GELLED |
| I-2 | 400 TBN magnesium sulfonate (40%) | NO GEL | NO GEL | NO GEL |
| I-3 | 400 TBN calcium alkyl-phenate (26%) | NO GEL | NO GEL | NO GEL |
| I-4 | 500 TBN sodium sulfonate (19%) | NO GEL | NO GEL | NO GEL |
| I-5 | zinc dithiophosphate, ~10% secondary (34%) | NO GEL | NO GEL | NO GEL |
| I-6 | zinc dithiophosphate, ~10% primary (35%) | NO GEL | NO GEL | NO GEL |
| I-7 | molybdenum dithiocarbamate (38%) | NO GEL | NO GEL | NO GEL |
| I-8 | 165 TBN calcium salicylate (63%) | NO GEL | NO GEL | NO GEL |

[1]Same note as in Table 1 above applies to Example I-1

[2]Example I-1 is the same sample as Example G-3 above, and included here for completeness.

Example Set J

Example Set J evaluates the polymer of G-4 above, an SBR copolymer functionalized with maleic anhydride where the polymer has a Mn of about 130,000 and was functionalized in oil. The samples are prepared and tested according to procedures described in Example Set A except that the polymer is present at 50% by weight of the polymer mixture as opposed to the 25% used in Example Set A. The observations for each example are provided in the table below.

TABLE 9

Gelation of MAA-130,000 Mn SBR Polymer Samples

| Ex | Surfactant (% surf in Surf Mix) | At Mixing | At 24 Hrs | At 4 Weeks |
|---|---|---|---|---|
| J-1 | 400 TBN calcium sulfonate (25%)[1,2] | LIGHT3 | GELLED | GELLED |
| J-2 | 400 TBN magnesium sulfonate (40%) | LIGHT3 | GELLED | GELLED |
| J-3 | 400 TBN calcium alkyl-phenate (26%) | GELLED | GELLED | GELLED |
| J-4 | 500 TBN sodium sulfonate (19%) | GELLED | GELLED | GELLED |
| J-5 | zinc dithiophosphate, ~10% secondary (34%) | TRACE | LIGHT[3] | LIGHT[3] |
| J-6 | zinc dithiophosphate, ~10% primary (35%) | LIGHT[3] | LIGHT[3] | LIGHT[3] |
| J-7 | molybdenum dithiocarbamate (38%) | NO GEL | NO GEL | NO GEL |
| J-8 | 165 TBN calcium salicylate (63%) | GELLED | GELLED | GELLED |

[1]Same note as in Table 1 above applies to Example J-1

[3]A result of "LIGHT" means the sample lightly gelled, which is more than a trace of gel but not enough to warrant to a full result of "GELLED".

These results of these example sets indicate that the combinations of functionalized polymer and surfactant that are present in the compositions of the invention have good gelation properties, such that the corresponding ANFO compositions will have good gelation properties as well.

Solid Fuel Example Sets

The following examples include compositions that have a solid fuel component present in combination with the liquid fuel component and demonstrate the ability of the present invention to control and prevent segregation of diesel fuel from a composition that contains AN prills, crumb rubber as a solid fuel component, diesel fuel as a liquid fuel component, a functionalized polymer, and a surfactant.

Example Set K

All of the examples in this example set are made with 94 grams of Ammonium Nitrate (AN) prills with poor fuel retention properties (having a poured bulk density of about 0.96 grams/cm$^3$) and 6 grams of a mixture of liquid fuel, solid fuel, functionalized polymer, and/or surfactant. The liquid fuel used in each of these examples is an ultra low sulfur diesel fuel, ULSD). The solid fuel used in each of these examples is a crumb rubber (CR). The functionalized polymer (POLY) used in this example set is the same as that used in Examples 1 to 5 above. The surfactant (SURF) used in this example set is the same as that used in Example A-1 above, a 400 TBN calcium sulfonate detergent itself 40% by weight diluent.

Each sample is prepared by weighing the AN prills, then adding the crumb rubber, using rollers and/or shaking the sample jar to mix the components, then adding the diesel fuel and shaking the sample jar to mix the components. If a polymer and surfactant are present, then a mixture containing a portion of the diesel fuel and all of the polymer is added and shaken into the sample, the a mixture containing the balance of the diesel fuel and all of the surfactant is added and shaken into the sample. The samples are then stored and observed for segregation and separation of the diesel fuel from the rest of the composition.

The table below summarizes the formulations and results for this example set:

TABLE 10

Stability of Samples with Mixtures of Liquid and Solid Fuels[1]

| Ex | Formulation (all % are wt %) | At Mixing | At 1 Week | At 4 Weeks |
|---|---|---|---|---|
| K-1 | COMP - 94% AN, 6% ULSD | No Sep | ULSD Sep | ULSD Sep |
| K-2 | COMP - 94% AN, 5% ULSD, 1% CR | No Sep | ULSD Sep | ULSD Sep |
| K-3 | COMP - 94% AN, 4% ULSD, 2% CR | No Sep | ULSD Sep | ULSD Sep |
| K-4 | COMP - 94% AN, 3% ULSD, 3% CR | No Sep | ULSD Sep | ULSD Sep |
| K-5 | INV - 94% AN, 3.5% ULSD, 1% CR, 1% POLY, 0.5% SURF | No Sep | No Sep | No Sep |
| K-6 | INV - 94% AN, 2.5% ULSD, 2% CR, 1% POLY, 0.5% SURF | No Sep | No Sep | No Sep |
| K-7 | INV - 94% AN, 1.5% ULSD, 3% CR, 1% POLY, 0.5% SURF | No Sep | No Sep | No Sep |
| K-8 | INV - 94% AN, 3.5% ULSD, 1% CR, 1% POLY, 0.5% SURF | No Sep | No Sep | No Sep |
| K-9 | INV - 94% AN, 2.5% ULSD, 2% CR, 1% POLY, 0.5% SURF | No Sep | No Sep | No Sep |
| K-10 | COMP - 94% AN, 6% ULSD (K-1 repeat) | No Sep | ULSD Sep | ULSD Sep |
| K-11 | INV - 94% AN, 4.5% ULSD, 0% CR, 1% POLY, 0.5% SURF | No Sep | No Sep | No Sep |
| K-12 | INV - 94% AN, 4.25% ULSD, 1% CR, 0.5% POLY, 0.25% SURF | No Sep | No Sep | No Sep |
| K-13 | INV - 94% AN, 3.25% ULSD, 2% CR, 0.5% POLY, 0.25% SURF | No Sep | No Sep | No Sep |
| K-14 | INV - 94% AN, 2.25% ULSD, 3% CR, 0.5% POLY, 0.25% SURF | No Sep | No Sep | No Sep |
| K-15 | INV - 94% AN, 4.25% ULSD, 1% CR, 0.5% POLY, 0.25% SURF | No Sep | No Sep | No Sep |
| K-16 | INV - 94% AN, 3.25% ULSD, 2% CR, 0.5% POLY, 0.25% SURF | No Sep | No Sep | No Sep |
| K-17 | INV - 94% AN, 5.25% ULSD, 0% CR, 0.5% POLY, 0.25% SURF | No Sep | No Sep | No Sep |

[1]Any separation of diesel fuel is an undesirable result. The rating "ULSD Sep" indicates separation of the diesel fuel was observed while a rating of "No Sep" indicates no separation was observed.

Examples K-5 and K-8 are identical expect that the ULSD and POLY mixtures and the ULSD and SURF mixtures used in their preparation had different dilutions. The same is true of Examples K-6 and K-9. As noted in the table Examples K-1 and K-10 are identical comparative repeats.

These results show that the combinations of functionalized polymer and surfactant that are present in the compositions of the invention are able to prevent the separation of a liquid fuel component in compositions, including those that also contain a solid fuel component.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, all percent values, ppm values and parts values are on a weight basis. Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention can be used together with ranges or amounts for any of the other elements. As used herein, the expression "consisting essentially of" permits the inclusion of substances that do not materially affect the basic and novel characteristics of the composition under consideration.

What is claimed is:

1. A composition comprising:

(a) from 92 to 96% of the total weight of the composition of ammonium nitrate;

(b) from 4 to 8% of the total weight of the composition of a fuel component;

(c) from 0.1 to 2.5% of the total weight of the composition of a functionalized polymer component;

(d) from 0.1 to 1.5% of the total weight of the composition of an oil-soluble anionic surfactant;

wherein the mixture of components (b), (c) and (d) form a gel that will not readily flow.

2. The composition of claim 1 wherein component (a) is in the form of agglomerates and/or prills.

3. The composition of claim 1 wherein the ammonium nitrate component is not capable of retaining at least 6% of the fuel component when used to make an ammonium nitrate fuel oil mixture.

4. The composition of claim 1 wherein the ammonium nitrate component has a poured bulk density greater than about 0.85 g/cc, an oil-absorption capacity of less than about 7%, or combinations thereof.

5. The composition of claim 1 wherein component (b) comprises diesel oil, mineral oil, vegetable oil, mono- and/or di-esters of vegetable oil, reclaimed oil, or combinations thereof; and may optionally further include a solid fuel component.

6. The composition of claim 1 wherein component (c) comprises the reaction product of an olefin copolymer and an unsaturated carboxylic acylating agent.

7. The composition of claim 6 wherein the unsaturated carboxylic acylating agent comprises maleic anhydride.

8. The composition of claim 6 wherein the polymer component is prepared via reactive extrusion.

9. The composition of claim 1 wherein component (c) comprises a maleic anhydride functionalized olefin copolymer having a number average molecular weight from 50,000 to 200,000.

10. The composition of claim 1 wherein component (d) delivers calcium ions, magnesium ions, sodium ions, zinc ions or combinations thereof to the composition.

11. The composition of claim 1 wherein component (d) comprises an overbased calcium sulfonate detergent, an overbased sodium sulfonate detergent, or combinations thereof.

12. A method for using an explosive in a mining operation comprising:

providing an explosive composition comprising the composition of claim 1; and loading said explosive composition into a blast hole that has been established in the earth.

13. A method of preparing an explosive composition, the method comprising the step of mixing: (a) from 92 to 96% of the total weight of the composition of ammonium nitrate; (b) from 4 to 8% of the total weight of the composition of a fuel component; (c) from 0.1 to 2.5% of the total weight of the composition of a functionalized polymer component; (d) from 0.1 to 1.5% of the total weight of the composition of an oil-soluble anionic surfactant;

wherein the mixture of components (b), (c) and (d) form a gel that will not readily flow.

* * * * *